United States Patent [19]

Cogswell et al.

[11] Patent Number: 4,867,435

[45] Date of Patent: Sep. 19, 1989

[54] APPARATUS FOR STACKING FOLDED SHEET MATERIAL

[75] Inventors: John Cogswell; Robert Fokos, both of Wayland, Mass.

[73] Assignee: Sequa Corporation, New York, N.Y.

[21] Appl. No.: 112,294

[22] Filed: Oct. 26, 1987

[51] Int. Cl.[4] ..... B65H 29/68

[52] U.S. Cl. ..... 271/182; 271/185; 271/202; 271/215

[58] Field of Search ..... 271/216, 202, 203, 270, 271/151, 182, 181, 184, 185, 215, 150

[56] References Cited

U.S. PATENT DOCUMENTS

| | | | |
|---|---|---|---|
| 2,644,685 | 7/1953 | Rockwell | 271/215 X |
| 3,653,656 | 4/1972 | Stobb | 271/185 |
| 4,177,982 | 12/1979 | Bewersdorf | 271/151 X |
| 4,200,016 | 4/1980 | Helmig | 271/202 X |
| 4,245,832 | 1/1981 | Klenk | 271/185 |
| 4,509,739 | 4/1985 | Kurokawa | 271/215 X |
| 4,643,626 | 2/1987 | Noguchi | 271/215 X |
| 4,718,656 | 1/1988 | Reist | 271/202 X |

FOREIGN PATENT DOCUMENTS 2025372 1/1980 United Kingdom ..... 271/202

*Primary Examiner*—Richard A. Schacher
*Attorney, Agent, or Firm*—Mitchell D. Bittman

[57] ABSTRACT

A stacking apparatus for signatures includes a signature-carrying belt positioned with respect to incoming signatures to raise the trailing edge of each signature and form a reverse shingle stream of signatures. A retarding wheel positioned above the signature carrying belt slows the travel of the signatures as they enter the stacker. The signatures pass through a nip created between the retarding wheel and the signature carrying belt. The signature carrying belt carries the reverse shingle stream from a horizontal orientation to a vertical orientation and then to a signature collector that includes a transport belt. A belt drive activated by a sensor of the pressure in the stack collected on the belt carriers the stack in a direction away from the signature carrying belt. The collector includes a vertical barrier that supports the collected signatures in a vertical orientation and automatically adjusts its position to accommodate varying quantities of signatures stacked in the collector.

20 Claims, 3 Drawing Sheets

APPARATUS FOR STACKING FOLDED SHEET MATERIAL

BACKGROUND OF THE INVENTION

This invention relates to the stacking of folded paper sheet signatures ("signatures") and more particularly to an apparatus and method for automatically and reliably stacking signatures delivered from web finishing equipment for a printing press.

Machines capable of stacking signatures have a wide range of uses in many industries. One such use is to collect paper that has been folded by an automatic folding machine. One known folding apparatus can fold freshly printed signatures in half or thirds at speeds at, or even in excess of, the line speed of a printing press. A stacker operating in conjunction with such a paper folder must be both fast and reliable. Specifically, a stacker used with such high speed on-line web finishing equipment for a printing press such as the aforementioned insert folder must be capable of stacking a flow of mutually spaced apart signatures at speeds of up to 60,000 signatures per hour. Of course, it is also of great commercial value to have a stacker which can operate reliably and at high speed in conjunction with off-line web finishing equipment.

A number of attempts have been made to produce a stacker which can reliably stack signatures at high speeds. One such stacker includes a belt which carries signatures in a horizontally oriented position towards a vertical stop wall. After the signatures strike the stop wall, they fall straight down into a stacking compartment in front of the wall. The stacker has not been very successful when operated at high speeds because signatures do not fall into the compartment in an orderly fashion. As a result, jams are likely to occur forcing the shut down of the printing process.

Another known stacker will take signatures which are part of an ordinary shingled stream of signatures which are traveling in a horizontal path and capture the shingle stream between a drum roll and a belt. The combination of the drum roll and the belt carries the signatures through a 180 degree turn. When the signatures come out of the 180 degree turn, they strike a stop wall which defines a stack. Each successive signature which is carried around a drum roll inserts itself beneath the preceding signature. As each signature is inserted beneath its preceding signature, the remainder of the stack is forced in an upward fashion in order to accomodate the following signatures. While this stacker may operate well at high speeds, the duration of such high speed operation is severely limited by restraints placed on the stack size. As the signatures build up, the stack above the entering signature becomes heavier. Eventually, the weight of the stack reaches a point where entering signatures can no longer force themselves under the stack. As a result, the entering signatures jam and the line must eventually be shut down to clear the jam.

In addition to being stacked at line speed, the signatures must be subject to a minimum of handling since it is still possible that, if there is printed material on the signatures, the ink on the signatures may be wet and subject to being smeared. It is also important that the stacker create an ordered stack and handle and stack any reasonably sized signatures. Also, changes in the size of the stack as more signatures are processed should not slow down the stacking, nor should it have any effect on the quality of the stack.

It is therefore a principal object of the present invention to provide an apparatus and method for stacking signatures received from a web finishing apparatus, particularly an automatic folder, at line speed or higher.

It is a further object of the present invention to provide a signature stacking apparatus which is capable of stacking signatures fresh off a printing press without excessive smearing of ink on the paper.

Another object of the present invention is to provide an apparatus and method for stacking signatures which produce an orderly stack.

Yet another object of the present invention is to provide an apparatus and method for stacking signatures which will stack signatures of variable sizes with a high degree of reliability.

SUMMARY OF THE INVENTION

The apparatus and method for stacking signatures of the present invention includes a signature sheet carrying belt which will receive and transport signatures from an on-line or off-line web finishing equipment for a printing press. As the signatures enter the stacker, it transforms a stream of spaced apart signatures into a "reverse" shingle stream, that is, with the leading edge of each signature nested under the trailing edge of the preceding signature. The stacker transports this reverse shingle stream to a signature collector which stacks the signatures vertically in a horizontally extending stack.

In a preferred embodiment, the stacker includes a signature carrying belt positioned alongside and slightly below the exit end of the web finishing equipment. The signature carrying belt will support the leading edge of each signature exiting the web finishing equipment. The trailing edge of the same signature will rise slightly above the exit end of the finishing apparatus while a more central portion of that signature rests on the exit end of the finishing equipment. By causing the trailing edge to rise, the next signature exiting the finishing apparatus will have its leading edge pass underneath the trailing edge of the preceding signature thereby creating a reverse shingle stream of signatures.

A retarding roll positioned above the signature carrying belt slows the travel speed of the product coming off the web finishing equipment so that the leading edge of a following signature will nest under the trailing edge of an exiting signature thereby creating the reverse shingle stream. After making contact with the retarding roll, the signatures pass as a reverse shingle stream through a nip between the retarding roll and the signature carrying belt. The retard roll rotates to drive the stream through the nip, but the speed of the rotation is sufficiently slow to produce the desired retardation. The belt then carries the signatures from an initial horizontal orientation to a vertical orientation. The signatures are guided through this change in orientation by a second belt positioned adjacent and above the signature carrying belt. The two belts capture the signatures in order to maintain the reverse shingle stream as they travel in a vertical direction.

The signature collector, which includes a belt for transporting the signatures, receives the signatures as they are traveling downwardly in the vertical orientation. A pressure transducer senses the pressure in the stack collected on the belt. When the pressure exceeds a preset level, the transducer activates a horizontal translation of the belt that carries the stack away from the shingle stream feed belts. Because the signatures travel in a reverse shingle stream, each signature entering the collector enters the stack behind the immediately preceding signature. The main signature carrying belt extends downwardly a sufficient distance to drive each signature down until its lower edge rests on the collector belt. A vertical barrier moves automatically in a horizontal direction to extend the size of the stack while still supporting the stacked signatures in a generally vertical orientation.

These and other features and objects of the present invention will be more fully understood from the following detailed description which should be read in light of the accompanying drawings.

DETAILED DESCRIPTION OF THE PREFERRED EMBODIMENT

Figure 1:
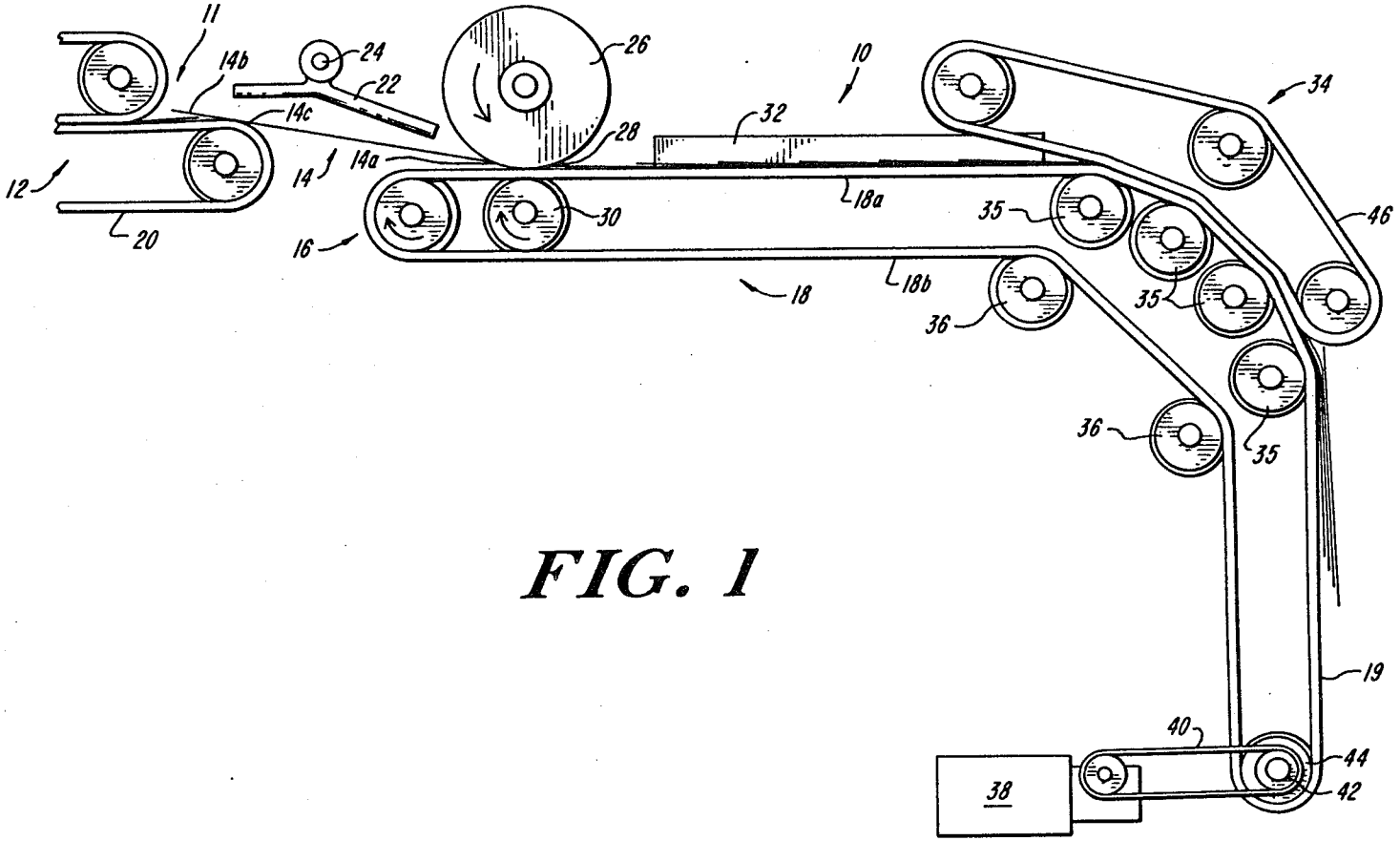
FIG. 1 is a view in side elevation of the front end of the stacking apparatus of the present invention shown in its operative relationship with the output end of a high speed folder.

As shown in FIG. 1, the stacking apparatus 10 of the present invention is positioned adjacent the exit end 11 of a high speed, on-line or off-line web finishing equipment 12 such as a folder. The finishing equipment 12 may carry signatures in any of a variety of arrangements including, but not limited to, carrying signatures on top of belts, between belts and on rollers. In any event, the signatures fed to the stacker 10 approach the exit end 11 in a spaced apart stream of single signatures.

In a preferred embodiment illustrated in FIG. 1, an input end 16 of the stacker 10 is positioned beneath the exit end 11 of the finishing apparatus 12. Also, the stacker 10 is positioned relative to the finishing apparatus 12 so that the leading edge **14*a* of each signature 14 rests on a main carrier belt 18 of the stacker 10 while the finishing apparatus supports the trailing end 14*b* of the same signature. By positioning the two apparatuses in such a fashion, the trailing end 14*b* of each signature 14 slants upwardly over the belts 20 of the finishing apparatus 12 while a slightly more central portion 14*c* of the signature rests on belt 20. By causing the trailing end of an exiting signature to slant up in such a manner, the leading edge of the following signature will rest under the trailing end 14*b* of the exiting signature 14 provided that the travel speed of the exiting signature is reduced relative to the speed of the signatures carried on the belt 20**. In other words, the leading edge of each signature will fall under the trailing edge of the preceding signature. The resulting signature configuration is termed herein as a "reverse" shingle stream.

An adjustable deflector 22 mounted on shaft 24 and positioned over the gap between the folder 12 and the stacker 10 guarantees that the stacker receives each signature 14 delivered by the folder 12. As each signature exits the folder, its leading end tends to flutter or fly up. The deflector plate 22 directs the leading edge **14*a* of the signature 14 downwardly towards the main stacker belt 18**.

A rotatable retarding roll 26 is spaced at or slightly above the upper surface of the belt 18 and horizontally from the exit end 11 a sufficient distance to create the aforementioned "raised tail edge" condition when the leading edge **14*a* of the exiting signature 14 arrives at the nip 28 between the roll and the belt. The retarding roll 26 serves several purposes. First, it guides the leading edges 14*a* to the nip 28 and the belt 18. The direction of rotation of the retarding roll 26 (counterclockwise as shown) assists in this guiding function. Second, and most importantly, the retard roll slows the forward velocity of the signature 14 from its travel speed through the folder to a somewhat slower speed of a reverse shingle stream carried by the main stacker belt 18. This slowing or "retard" of the signatures as they exit is important to create the reverse shingle stream. It momentarily causes a signature to lie with its trailing edge 14*b* raised as shown in FIG. 1. The delay introduced by the retard roll is sufficient to allow the leading edge of the following signature to nest under this raised trailing edge. As a steady flow of signatures reaches this condition, the preceding signatures guide, and to some extent retard, the following signatures. But in any case, the retard roll 26** is vital, even after the reverse shingle stream has formed, to the continued creation of this shingle stream.

A third function of the retard roll 26 is to drive the reverse shingle stream of signatures through the nip 28 and along the belt 18. The retard roll 26 preferably rotates at its periphery at the same speed as the belt 18 to avoid smearing the ink if the signatures contain fresh printing. After the signatures pass through the nip 28, belts 18 carry the signatures as part of a substantially flat, horizontally-oriented reverse shingle stream, as shown. A roll 30 positioned on the opposite side of belt 18 from the retarding roll 26 prevents the accumulating stream of signatures in the nip 28 from depressing belt 18. This therefore controls the dimensions of the reverse shingle stream formed at the retard roll 26.

As the reverse shingle stream of signatures 14 is carried from nip 28 by belt 18 a guide wall 32 will align the lateral edges of the signatures 14 and then maintain this alignment while the belt 18 continues to carry the signatures in a horizontal orientation.

The signatures 14 continue traveling on belt 18 until they reach a re-orientation section 34 where the stacker carries the reverse shingle stream from a horizontal orientation to a vertical orientation. In the re-orientation section 34, the belt 18 rides on two sets of pulleys with the upper sheet-contacting, or "tight", side **18*a* of belt 18 guided by a set of four pulleys 35 positioned adjacent each other, and the lower, or "slack", side 18*b* of belt 18 guided by two pulleys 36. Each of the pulleys 36 is positioned adjacent one of the end pulleys 35 of the four. The use of four pulleys allows the re-orientation section 34 to gradually change the orientation of the traveling signatures thereby avoiding creasing of the signatures. As the signatures 14 exit the re-orientation section 34, they are driven by the lowermost run 19 of the belt 18 to a signature collector 50**.

An auxiliary carrier belt 46 contacts the reverse shingle stream on their upper surface to hold them in place as they travel through the re-orientation section. The belt 18 drives the upper belt 46 by contact, and a motor 38 operates a drive belt 40 which in turn drives belt 18 through a pulley 44.

Figure 2:
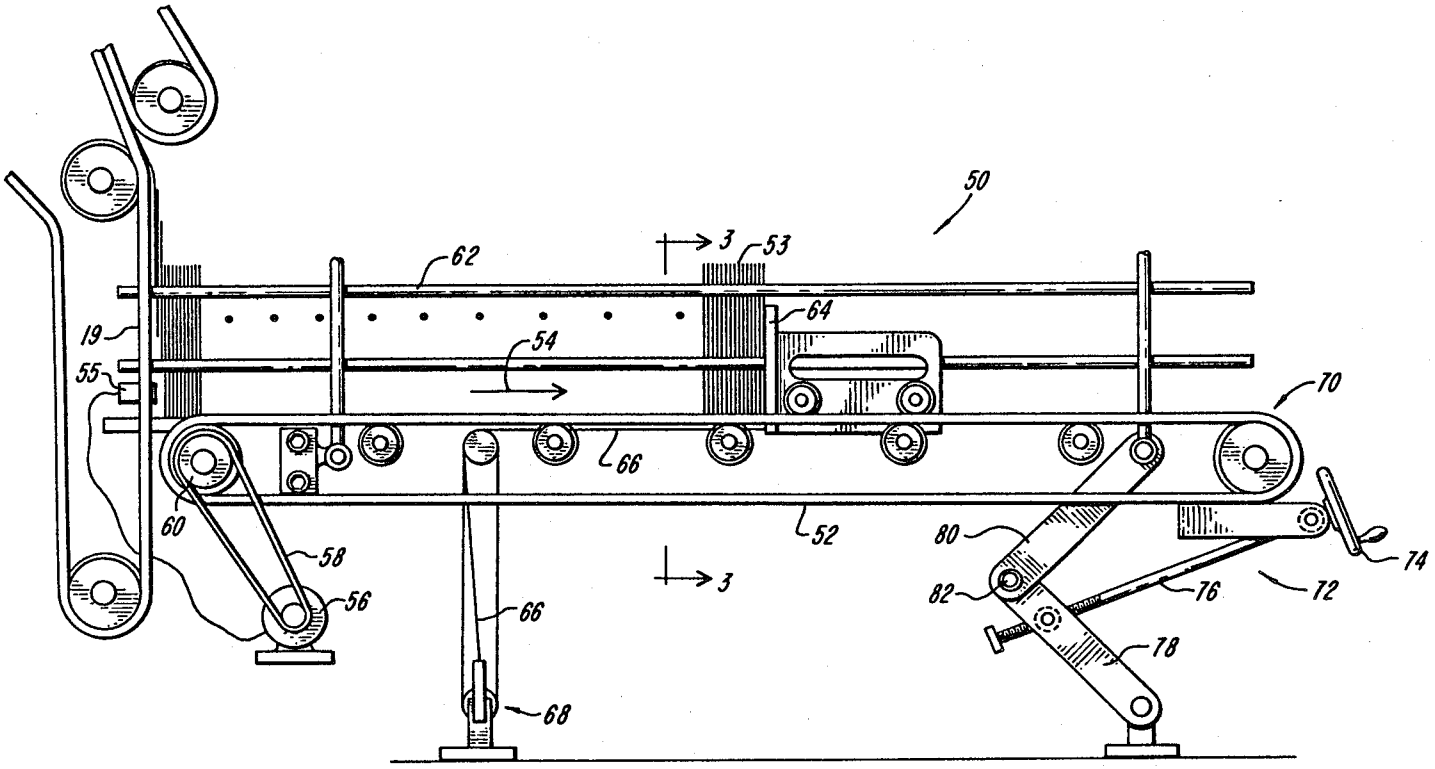
FIG. 2 is a view in side elevation of the signature collector compartment of the stacking apparatus of FIG. 1.

As shown in FIG. 2, the signature collector 50 includes a belt 52 which acts as a "floor" to support the signatures as they leave the control of the belt 46 and have attained a vertical orientation in a stack 53. The belt 52 translates under control of a motor 56 so that the stacked signatures on the upper run of the belt 50 moves in the direction of arrow 54 to accommodate the succeeding signatures entering the collector. A pressure transducer 55 senses the pressure in the stack collected on the belt 52. When the pressure achieves a preselected value, it activates the motor 56 to move the upper run of the belt 52, and therefore the stack 53, to the right in the direction 54 until the stack pressure falls to an acceptable level—one which will allow additional signatures to enter the stack 53 at its lefthand end, as shown, but which will also maintain the signatures in an upright or vertical orientation on the belt 52.

As belt 52 carries the signatures 14 through the collector 50 their vertical orientation is maintained by two elements. First, containing walls 62 positioned on each side of the belt 52 keep the signatures from falling off the belt. These containing walls 62 can be adjusted relative to belts 52 to accomodate signatures of various widths. Second, a movable barrier 64 prevents the signatures from falling face down onto belt 52. The barrier 64 acts as an adjustable end wall in order to accommodate varying quantities of signatures 14, or stated in other words, it allows the stack to grow horizontally while maintaining an acceptable stack pressure and signature orientation. Before any signatures have entered the signature collector 50, barrier 64 is positioned a sufficient distance away from belt 18 so that when a signature 14 enters the collector 50 it will not fall face down on the belt. The belt 52 then carries the edge of the signature 14 which has made contact with belt 52 towards the barrier 64 while the barrier 64 remains in its initial position. As a result, the signature is straightened up against the barrier 64 as other signatures fall onto the belt 52 behind the straightened signature. The belt 52 straightens all following signatures in like fashion with the preceding signatures acting as the vertical barrier.

Figure 3:
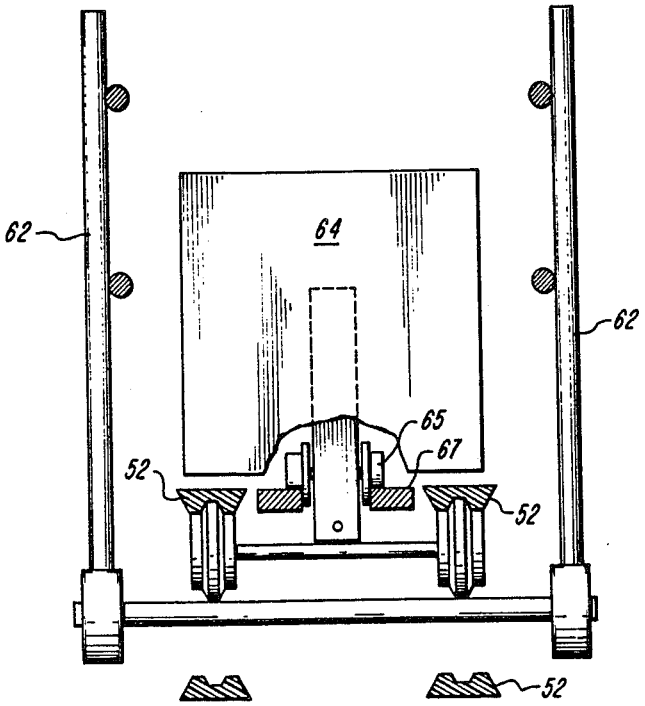
FIG. 3 is a cross-sectional view taken along line 3—3 of FIG. 1.

As shown in FIG. 3, the movable barrier 64 includes wheels 65 which ride on tracks 67 that enable the barrier 64 to move independently of the belt 52. Once the portion of the collector 50 between the belt 18 and the movable barrier 64 becomes filled with signatures, the barrier 64 moves in the direction of arrow 54 in order to accommodate more signatures entering the collector 50 and thereby create a horizontally extending and expandable stack. Line 66, connected to a spring loaded pulley system 68, spring biases the barrier 64 to the left, as shown, in the direction opposite to the arrow 54 and the stack growth direction. The barrier 64 exerts pressure on the stack that assists in maintaining a well-ordered, neat stack. In addition, any limits imposed upon the stacking capabilities of the collector 50 are limited to the overall length of the collector 50 since the barrier 64 can move along the entire length of the stacker. Of course, when the stack 53 grows sufficiently large, a worker can remove a comfortably sized portion of the stack by hand. This reduces the stack size. To maintain a sufficient intrastack pressure to hold the signatures remaining in the collector 50 in a vertical orientation, the system 68 quickly draws the barrier 64 to the left once the stack portion is removed.

Mechanism 72 having an adjusting wheel 74 sets the vertical position of the end of the collector opposite the belt 18. Connected to adjusting wheel 74 is an adjusting shaft 76 threaded through displacement bar 78. A second displacement bar 80 is attached to guide wall 62. The displacement walls 78, 80 pivot around joint 82, and when the adjusting wheel 74 is rotated, the guide wall can be either raised or lowered with respect to the belt 52. The front end of the collector 50 includes a similar adjusting mechanism, which is not shown.

In the method of the present invention, a stream of signatures moving generally horizontally in a spaced apart relationship are formed into a reverse shingle stream. The shingle stream is then transported from a horizontal orientation at its formation site to a vertical orientation for formation of a horizontally extending stack of vertically oriented signatures. The method includes the step of stopping the downward movement of the signatures following their reorientation, the formation of the aforementioned stack, and the movement of the stack as a whole in a direction away from the entry point of the shingle stream to allow the stack to grow in an orderly manner. The method also includes the steps of sensing the intra-stack pressure and moving the stack to maintain the pressure within a preselected range. In its preferred form the method of the present invention also includes the steps of supporting the far end of the stack in an adjustable manner to maintain the stack order and to control intra-stack pressure.

The stacker disclosed herein provides a number of advantages not found in prior art stackers. Principal among the advantages is the ability of the stacker to vertically stack signatures in a horizontally extending stack. A horizontally extending stack eliminates problems caused by the weight of a large stack encountered with prior art stacks. In addition, the ability of the stacker to create a reverse shingle stream from a stream of separate, non-overlapping signatures makes the stacker significantly more reliable than prior art stackers.

While the stacking apparatus and method of the present invention have been described with reference to its preferred embodiments, various modifications and alterations will occur to those skilled in the art from the foregoing detailed description and the accompanying drawings. Although the invention has been described as carrying signatures on a single belt, the carrying means should not be limited to single belts nor to belts at all. Any other carrying means could be similarly used to carry signatures through the apparatus. These and other modifications and variations are intended to fall within the scope of the appended claims.

What is claimed is:

1. An apparatus for stacking signatures traveling in a first direction at a first horizontal level, comprising:

at least one carrier belt that receives said signatures at a second horizontal level and transports said signatures from said first horizontal direction to a vertical orientation, means for creating a reverse shingle stream of said signatures including (i) means for tilting up a trailing end of said signatures, and (ii) signature retarding means positioned above and adjacent said at least one carrier belt, said signature retarding means slowing the advance of said signatures, whereby as the advance of said signatures is slowed, a leading edge of the succeeding signature passes beneath said tilted up trailing edge to produce said reverse shingle stream;

said at least one carrier belt, by transporting said signatures to said vertical orientation, producing a vertically oriented reverse single stream; and means positioned at an output end of said at least one carrier belt for receiving said vertically oriented reverse shingle stream in a horizontally extending stack, said receiving means including at least one conveying belt having an upper run located at a third horizontal level below said first horizontal level, said run supporting said signatures in a laterally extending stack, said at least one conveying belt being movable to transport said stack along said first direction at said third horizontal level.

2. The apparatus for stacking signature of claim 1 wherein said means for tilting up a trailing end of a signature comprises:

positioning an input end of the apparatus at a second horizontal level below an exit end of a web finishing apparatus, said web finishing apparatus being positioned at said first horizontal level.

3. The apparatus for stacking signatures of claim 1 wherein said sheet retarding means is a roll mounted for rotation, said roll deflecting signatures toward said means for receiving and transporting the said signatures.

4. The apparatus for stacking signatures of claim 1 further comprising means for aligning the lateral edges of said signatures.

5. The apparatus for stacking signatures of claim 4 wherein said means for aligning the lateral edge is of said signatures comprises guide walls positioned along each side of said means for receiving and transporting signatures, said guide walls being adjustable to accommodate various sizes of signatures.

6. The apparatus for stacking signatures of claim 1 wherein said means for receiving said signatures in a horizontally extending stack further comprises:

barrier means against which said signatures are stacked, said barrier means being adjustable in said first direction.

7. The apparatus for stacking signatures of claim 6 further comprising containing walls positioned on each side of said belt, said containing walls being adjustable in a second direction perpendicular to said first direction.

8. An apparatus for stacking signatures traveling in web finishing apparatus in a first direction at a first horizontal level comprising:

signature carrying means having an input end positioned at a second horizontal level a first distance below said first horizontal level, said signature carrying means also being positioned adjacent at a second distance from said web finishing equipment, said first and second distances being less than a length of a signature measured along an axis of the signature parallel to said first direction, said carrying means transporting signatures in said first direction through a portion of the apparatus;

signature retarding means positioned above and adjacent said carrying means for slowing the advance of the signatures, said retarding means including deflecting means for directing a leading edge of said signatures toward said carrying means;

means for collecting signatures transported by said carrying means;

whereby as signatures are fed from the web finishing equipment to said carrying means, they are arranged in a reverse shingle stream of signatures.

9. The apparatus for stacking signatures of claim 8 wherein said carrying means comprises at least one signature supporting endless belt, a portion of said belt being adapted for movement in said first direction.

10. The apparatus for stacking signatures of claim 8 wherein said retarding means comprises a rotating roll that directs signatures striking said roll towards said carrying means.

11. The apparatus for stacking signatures of claim 8 wherein said roll and said belt have substantially equal surface speeds adjacent said signatures.

12. The apparatus for stacking signatures of claim 10 wherein said roll is in contact with said carrying means.

13. The apparatus for stacking signatures of claim 8 wherein guide walls are positioned alongside said carrying means, said guide walls being adjustable relative to said carrying means to accommodate various sizes of signatures, said guide walls serving to align the lateral edges as the signatures are transported by said carrying means.

14. The apparatus for stacking signatures of claim 8 wherein said collecting means comprises:

two opposing belts adapted for carrying the cut signatures from a substantially horizontal orientation to a substantially vertical orientation, said two belts operating at the same speed;

carrying means for receiving, transporting and packing the stacked signatures within a collecting compartment;

barrier means against which said signatures are stacked.

15. The apparatus for stacking signatures of claim 14 wherein said carrying means further comprises at least one belt for receiving, transporting and packing said stacked signatures within said collecting compartment.

16. The apparatus for stacking signatures of claim 15 wherein said barrier means is adjustable in said first direction so as to vary the stacking capacity of said collecting compartment.

17. The apparatus for stacking signatures of claim 14 wherein said collecting means further comprising containing walls positioned on each side of said carrying means for containing said stacked signatures within said collecting compartment, said containing walls being adjustable in a second direction perpendicular to said first direction.

18. The apparatus for stacking signatures of claim 8 wherein a deflector plate is positioned above a gap created by locating said stacking apparatus a second distance from said web finishing apparatus, said deflector plate deflecting signatures fed from said web finishing apparatus toward said stacking apparatus.

19. A method for stacking signatures fed from a web finishing apparatus, the signatures travelling on a first horizontal level in a first direction and at a first speed, comprising the steps of:

positioning the stacking apparatus slightly below said first horizontal level at a second horizontal level and spaced from the web finishing apparatus so that a signature passing from said web finishing apparatus to said stacking apparatus is tilted to raise its trailing edge;

reducing the first speed of travel of a signature so that signatures enter the stacking apparatus at a second speed, said second speed being slower than said first speed thereby enabling a leading edge of each signature to pass beneath said tilted-up trailing edge of a preceding signature in order to create a reverse shingle stream of signatures;

converting orientation of travel of said signatures from said horizontal level to a vertical orientation; and stopping downward movement of said signatures following said converting of said orientation of said signatures by interposing a movable conveyor belt to define the bottom of the stack of vertically oriented signatures where the stack extends;

sensing an intra-stack pressure, and driving said stack laterally in response to said sensed pressure to maintain said pressure within a preselected range.

20. The method of stacking signatures of claim 19 further comprising:

supporting an end of said stack in an adjustable manner to maintain stack order and control said intra-stack pressure.

* * * * *